United States Patent [19]

Wellman

[11] 4,192,473

[45] Mar. 11, 1980

[54] WIRE REEL

[76] Inventor: Gerald A. Wellman, P. O. Box 1274, Rifle, Colo. 81650

[21] Appl. No.: 961,160

[22] Filed: Nov. 16, 1978

[51] Int. Cl.[2] ..... B65H 75/02; B65H 75/22

[52] U.S. Cl. ..... 242/84; 242/110; 242/127; 242/129

[58] Field of Search ..... 242/110.3, 110, 129, 242/127, 104, 84, 94, 77

[56] References Cited

U.S. PATENT DOCUMENTS

| | | | |
|---|---|---|---|
| 83,270 | 10/1868 | Fenner | 242/110 |
| 637,451 | 11/1899 | Fahrmeier | 242/84 |
| 1,347,697 | 7/1920 | Harbaugh | 242/104 X |
| 1,444,154 | 2/1923 | Jenks | 242/104 X |
| 2,441,883 | 5/1948 | Johnson | 242/84 X |
| 2,583,667 | 1/1952 | Pratt | 242/84 |
| 2,625,342 | 1/1953 | Moran | 242/110 X |

*Primary Examiner*—George F. Mautz
*Attorney, Agent, or Firm*—Robert K. Rhea

[57] ABSTRACT

A reel for winding up and paying out strands of wire comprising a frame having a central hub and four spoke-like arms extending radially from the hub and supporting a U-shaped wire strand nesting member at their outer end. At least two of the U-shaped members are pivotally connected for movement in a lateral direction, normal to the plane of the arms, for releasing and receiving a coil of wire. A pair of handles project in axial alignment from opposing sides of the hub normal to the plane of the arms.

1 Claim, 3 Drawing Figures

WIRE REEL

BACKGROUND OF THE INVENTION

1. Field of the Invention

The present invention relates to wire reels and more particularly to a reel for winding up or paying out a strand of fence wire, such as barbed wire.

When disassembling a stock enclosing fence, such as a barbed wire fence formed by a plurality of strands of barbed wire, it has been common practice to manually roll up each individual wire strand after removing it from the posts by forming a coil, approximately one meter in diameter, by one end portion of the wire strand and thereafter rolling this coil in a winding up action of the wire as by rolling it along the surface of the earth toward the other end of the wire strand. This action is generally satisfactory but has the disadvantage that heavy weight leather gloves must be worn as a protection for the hands against the barbs of the wire and is time consuming in that the roll of wire progressively increases in mass and care must be exercised in the winding up action to insure juxtaposition of the wire convolutions so that the reel forms a tire-like coil.

2. Description of the Prior Art

Prior patents, such as U.S. Pat. Nos. 325,394; 2,644,650; 3,134,558 and 3,584,809, generally disclose reels or containers for receiving coils of wire or rope for paying out the strand and preventing entanglement of the convolutions thereof during the paying out action.

This invention provides a wire reel frame which may be moved along a strand of wire disposed on the surface of the earth for progressively winding the wire thereon by rotation of the reel about its hub axis or which may be supported and manually rotated for drawing the wire to the reel in a winding up action of the wire around the periphery of the reel.

SUMMARY OF THE INVENTION

The wire reel frame is formed by a six-way cross forming a hub portion having four equally spaced spoke-like arms projecting radially from the cross in a common plane. A U-shaped wire strand nesting member is secured to the outwardly projecting end portion of each of the arms with the plane of the respective U-shaped member normal to the plane of the arms. At least two of the U-shaped members are pivotally connected with its respective arm for movement in a lateral direction normal to the plane of the arms for releasing or installing a coil of wire on the reel. The other two openings of the hub supports a pair of axially aligned handles projecting normal toward the plane of the arms for manually supporting and carrying the reel.

The principal object of this invention is to provide a collapsible manually portable wire reel for winding up or paying out strands of fence wire.

DESCRIPTION OF THE PREFERRED EMBODIMENT

Figure 1:
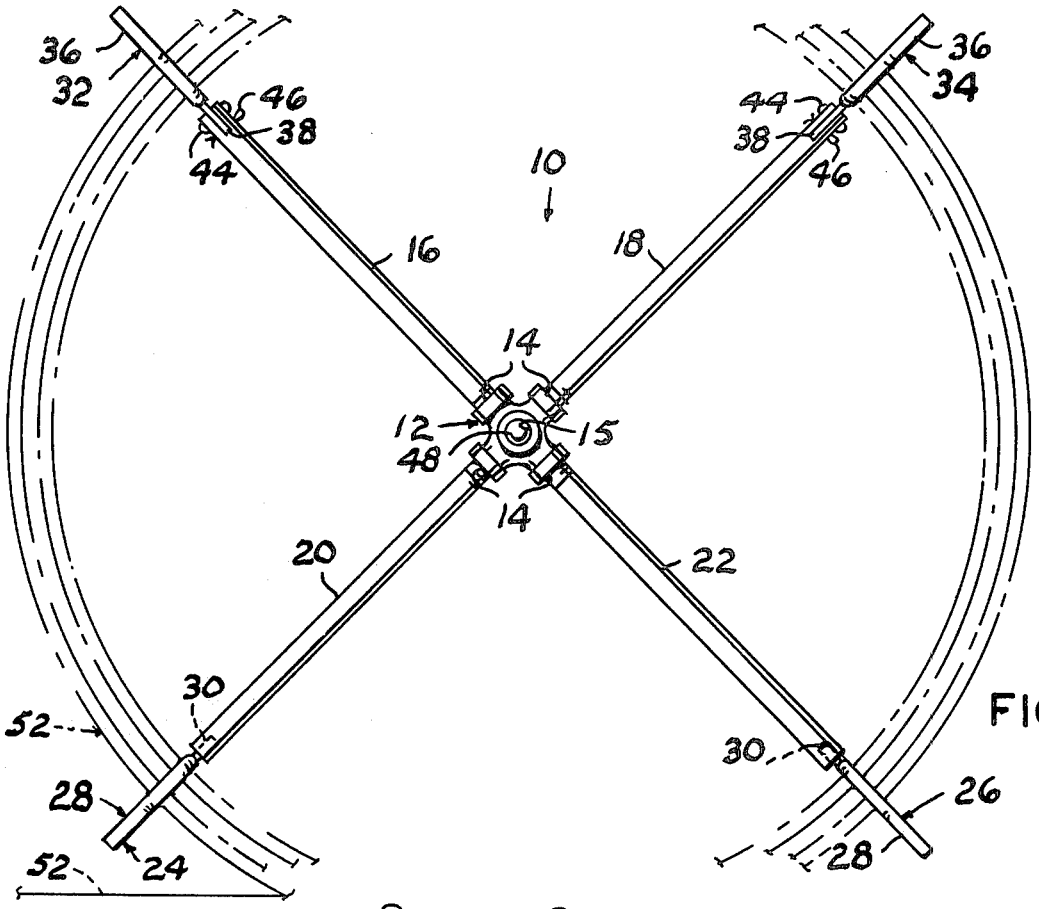
FIG. 1 is a side elevational view of the reel illustrating, by broken lines, the relative position of a wire strand wound thereon.

Like characters of reference designate like parts in those figures of the drawings in which they occur.

In the drawings:

The reference numeral 10 indicates the reel, as a whole, which is cross-shaped in general configuration. The reel 10 comprises a six-way cross forming a hub portion 12 having four internally threaded 90° spaced outlets 14 lying in a common plane and having a pair of opposed outlets 15 normal to the plane of the outlets 14. Four elongated equal length tubular arms 16, 18, 20 and 22 are respectively threadedly connected at one end with the hub outlets 14 to project radially therefrom.

A pair of wire strand receiving brackets 24 and 26, each comprising a rod-like U-shaped member 28 having a stem 30 connected at one end with the bight portion of the U-shape and secured at its other end portion within the outwardly projecting end of the respective arm 20 and 22. The plane of the respective U-shaped bracket 24 and 26 is normal to the plane of the arms 16–22.

A second pair of wire brackets 32 and 34, each similarly comprising a rod member 36 defining a U-shape, is provided with a section of strap metal 38 secured at one end to the U-shaped rod bight portion 40 with the plane of the strap metal 38 in the plane of the U-shape. The respective strap metal 38 is nested at its other end portion within a slot transversely formed in the outwardly disposed end portion of the respective legs 16 and 18 normal to the plane of the arms 16–22. The U-shaped brackets thus form aligned arcuate abutment surfaces facing outwardly from the reel hub.

Figure 2:
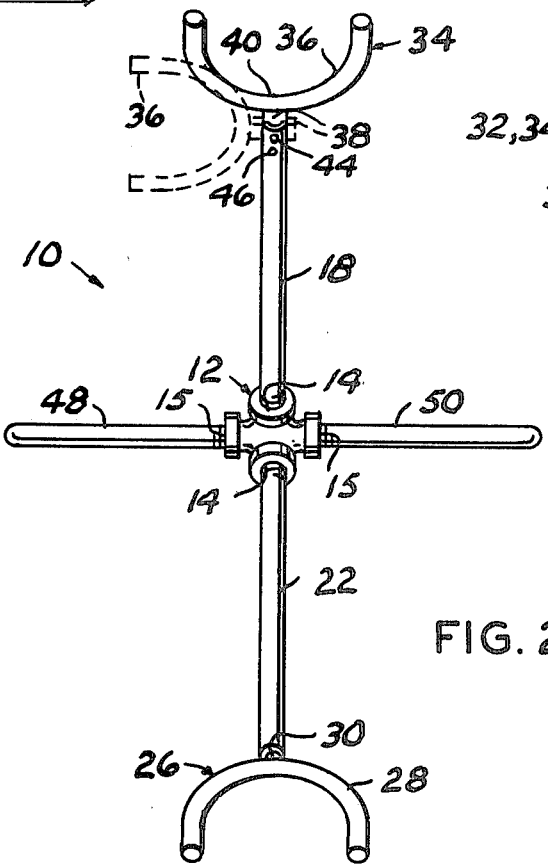
FIG. 2 is a right side elevational view of FIG. 1 illustrating, by dotted lines, the relative position of one U-shaped member when pivoted laterally of the plane of the arms; and, FIG. 3 is an elevational view of one of the pivoting U-shaped members, per se.
Figure 3:
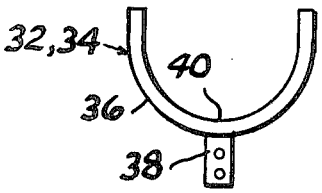

A rivet 44, or the like, secures the strap member 38 to the respective leg 16 and 18 permitting pivoting movement of the wire brackets 34 and 36 laterally of the plane of the reel, as shown by dotted lines (FIG. 2). The brackets 34 and 36 are maintained in the solid line position of the drawings by a cotter pin 46 extending through the respective strap member 38 and respective legs 16 and 18.

The reel 10 further includes a pair of rods or tubular handles 48 and 50 of less length than the length of the arms which are threadedly connected with the hub openings 15 on opposing sides of the cross normal to the plane of the arms.

Operation

In operation, with the wire reel assembled as described hereinabove, the reel is manually supported by the handles and one end of a wire 52 to be reeled in is secured to one of the brackets, such as the bracket 24 or 26, and the wire is then progressively wound around the reel by either moving the wire reel along the length of the strand of wire 52 or by holding the wire reel in one position and manually rotating the reel to draw the wire toward the reel as it is wound up in the position shown by the broken lines (FIG. 1). After winding up the coil of wire 52, the two cotter pins 46 are removed permitting the brackets 32 and 34 to pivot in a lateral direction and release the coiled wire from the reel.

The coil of wire 52 may be installed on the reel for paying out the wire by reversing the above described wire reeling in action.

The reel may be disassembled for shipment or storage by unscrewing the arms and handles from the hub.

Obviously the invention is susceptible to changes or alterations without defeating its practicability. Therefore, I do not wish to be confined to the preferred embodiment shown in the drawings and described herein.

I claim:

1. A reel for winding up or paying out a wire strand, comprising:

a rigid frame comprising a hub portion and a plurality of threadedly connected arms radially extending equidistant from said hub portion in substantially coplanar relation at least one of said arms having a transverse slot, normal to the plane of said arms, in its end portion facing away from said hub portion;

first and second rigid wire bracket means centrally secured to the end portion of at least two other said arms opposite the hub portion for nesting a plurality of convolutions of wire strands when wound thereon, said rigid wire bracket means comprising a U-shaped member forming an arcuate abutment surface facing outwardly from the respective arm in a plane normal to the plane of said arms;

a third U-shaped member;

a strap member secured to the bight portion of said third U-shaped member in the plane of the third U-shaped member and being freely received by the arm transverse slot;

means including a rivet and a removable cotter pin for securing said strap member within the slot permitting selective lateral pivoting movement of said third U-shaped member relative to the plane of said arms; and, a pair of axially aligned rod-like handles removably projecting from opposing surfaces of said hub portion normal to the plane of said arms for manually moving said reel across the surface of the earth in a rolling wheel-like wire winding up or paying out action.

* * * * *